US006668571B1

(12) United States Patent
Bertotti et al.

(10) Patent No.: US 6,668,571 B1
(45) Date of Patent: Dec. 30, 2003

(54) REFRIGERANT COMPRESSOR DRIVEN BY VARIABLE SUPPLY FREQUENCY MOTOR

(75) Inventors: Tiziano Bertotti, Belluno (IT); Fabrizio Carli, Francenigo (IT); Roberto Peruzzo, Porcia (IT)

(73) Assignee: Zanussi Elettromeccanica S.p.A., Pordenone (IT)

( * ) Notice: Subject to any disclaimer, the term of this patent is extended or adjusted under 35 U.S.C. 154(b) by 0 days.

(21) Appl. No.: 09/980,998

(22) PCT Filed: Apr. 26, 2000

(86) PCT No.: PCT/EP00/03703

§ 371 (c)(1),
(2), (4) Date: Feb. 12, 2002

(87) PCT Pub. No.: WO00/79188

PCT Pub. Date: Dec. 28, 2000

(30) Foreign Application Priority Data

Jun. 22, 1999 (IT) ..... PN99A0053

(51) Int. Cl.[7] ..... F25B 1/00; F25B 49/00
(52) U.S. Cl. ..... 62/228.4; 62/230
(58) Field of Search ..... 62/228.4, 230, 62/228.1, 208, 209

(56) References Cited

U.S. PATENT DOCUMENTS 4,407,139 A 10/1983 Ide et al.
4,748,822 A * 6/1988 Erbs et al. ..... 62/213
4,831,313 A 5/1989 Beilfuss
4,831,836 A 5/1989 Matsuoka
5,005,365 A 4/1991 Lynch
5,410,230 A 4/1995 Bessler et al.
5,423,192 A * 6/1995 Young et al. ..... 62/228.4
5,628,201 A * 5/1997 Bahel et al. ..... 62/211
5,950,443 A * 9/1999 Meyer et al. ..... 62/228.5
6,286,326 B1 * 9/2001 Kopko ..... 62/179

FOREIGN PATENT DOCUMENTS

EP 583560 A 2/1994
EP 854333 7/1998
WO 15790 A 4/1998

* cited by examiner

*Primary Examiner*—Marc Norman
(74) *Attorney, Agent, or Firm*—Pearne & Gordon LLP

(57) ABSTRACT

A refrigerant compressor driven by an electric motor, whose supply frequency is selectively variable between a discrete number of values ($f_1$, $f_2$, $f_T$) as a function of an input signal, uses control means integrated in the compressor to monitor two or more quantities that are variable with time in a mutually independent manner, of which at least one is representative of the actual operating conditions of the appliance. The control means also generates the input signal with a value that corresponds to a pre-established combination of the monitored quantities.

4 Claims, 2 Drawing Sheets

REFRIGERANT COMPRESSOR DRIVEN BY VARIABLE SUPPLY FREQUENCY MOTOR

This application claims the benefit of International Application Number PCT/EP00/03703, which was published in English on Dec. 28, 2000.

BACKGROUND OF THE INVENTION

The present invention refers to a compressor of the refrigerant medium of a refrigeration apparatus for home or similar use, namely of the type driven by a variable supply-frequency electric motor.

The importance that is being ascribed also by public authorities to the limitation, ie. reduction in the energy usage of home appliances in general has led to the issuance of a number of Directives, eg. by the European Commission, which, to the purpose of bringing about an overall reduction on the so-called greenhouse effect, practically forbid appliances to be put on the market which use too high an amount of energy to perform the duty they are required to ensure. This applies in particular to compression-type refrigerating appliances, which are largely diffused in all countries worldwide.

In view of assuring compliance with these Directives, proposals are largely known to have been made concerning the use, in a generalized manner, of refrigerant medium compressors driven by an electric motor which, instead of operating intermittently as this is the case in traditional appliances, operates continuously, but at a variable speed. In theory, a motor of such a kind is therefore capable of operating at anyone of the infinite values n comprised between a higher limit $n_s$ and a lower limit $n_i$.

In order to constantly ensure an optimum storage condition of the foodstuffs stored in the appliance, the above cited limiting values $n_s$ and $n_i$ are pre-set in accordance with the thermal load which is generally known to be in a proportion with the difference of the temperature $T_e$ of the ambient where the appliance is installed (which, in the case of the climatic class defined as ST, is comprised between +10° C. and +38° C.) to the temperature $T_1$ of the room or compartment where the foodstuffs are stored (which, in the case of a so-called "cooler" refrigeration appliance, is comprised between +2° C. and +8° C.). In theory, the ratio of $n_s$ to $n_i$ should be equal to 19. However, owing to a number of well-known practical difficulties, including the risk of an inadequate lubrication at the low running speeds of the compressor motor, said ratio $n_s$ $n_i$ between the speed limits of the motor of the compressor actually amounts to approx. 3. The preservation of the stored foodstuffs is therefore ensured in an optimum manner only under just a few ones of the actual operating conditions of the appliance, which in fact may deviate even considerably from reality.

A second major drawback deriving from the use of a compressor driven by a variable-speed motor lies in the fact that this requires the refrigeration appliance to make use of a special thermostatic temperature control system that differs both as far as the hardware and the software are concerned from the systems currently used in traditional refrigeration appliances, in which the motor of the compressor operates intermittently at a single speed. A manufacturer of refrigeration appliances is thus forced to face a time-consuming and expensive job of redesigning and testing each single appliance model included in his manufacturing range.

WO-A-98/15790 discloses a speed control of a compressor which is based on a simple ON/OFF signal issued by a thermostat located in the surroundings to be cooled. The method according to said patent is characterised in that the starting speed of the compressor in a following ON period is reduced in relation to the final speed in the previous ON period. Therefore, there is only one parameter (compressor speed) that is measured and compared in two different stages.

EP-A-0 583 560 discloses a refrigerator provided with a compressor driven by an electric 3-phase motor connected with a mono-phase electric line. The control is made on the supply of electric current to the motor by means of a frequency converter of a mono-three phase type. So, the "duty-cycle" of the compressor, which is the more significant parameter for an efficient control, is not taken into consideration.

U.S. Pat. No. 4,831,836 discloses a motor compressor for air conditioners, wherein the speed is regulated through a frequency control and means for detecting a difference between a room temperature and a predetermined temperature. In a first solution, the parameter detected is a value of the motor electric current, which is used to vary the frequency of the same motor. In a second embodiment, a pressure within the compressor is detected to control the current of the motor. In both cases, the control is based on the detection of only one parameter and there is the need to employ a specific additional sensor (current or pressure sensor).

U.S. Pat. No. 4,407,139 discloses a method for controlling an air conditioning system, said method being based on determining a frequency set value in accordance with a deviation of a detected temperature of the air to be conditioned with reference to a set temperature. Even in this case there is only one parameter detected and said parameter is not the "duty cycle" of the compressor nor the time of functioning the same.

U.S. Pat. No. 5,410,230 discloses a centralised system for heating, conditioning and ventilating a space, which comprises a plurality of motors to drive the various components of the system. Means responsive to the temperature of the air in the space generates a temperature signal having a cycling parameter which corresponds to the temperature of the air in the space as it rises and falls. Therefore, the control is of a continuous type, always carried out on the basis of only one parameter.

A different type of compressor, disclosed in the publication EP-A-0 490 089, is driven by a motor that is capable of operating selectively at a discrete number of speeds (two or, at most, three) and has a volume displacement capacity that is relatively increased with respect to the one of equivalent compressors driven by a single-speed motor. The first speed $n_1$ of the motor, which may be in the order of magnitude of 2,000 rpm, is used in the operating periods of the appliance in which the need or opportunity arises for the energy usage of the same appliance to be minimized (ie. the so-called "preservation periods"); the second speed $n_2$ of the motor, which may be in the order of 2,800 rpm, and the possibly provided third speed $n_T$, which may amount to something as 3,200 rpm, are on the contrary used when the appliance needs to ensure a particularly sustained refrigeration capacity, such as for instance in such transient periods as a starting after a prolonged pause, or is working under particularly heavy or demanding operating conditions. Switching over from a speed to another one is performed, in the cases in which the motor is of the brushless type, by means of a device adapted to control the supply frequency.

SUMMARY OF THE INVENTION

It is a main purpose of the present invention to provide a compressor of refrigerant medium of this second kind, whose electric driving motor is capable of switching over in an automatic manner from a supply frequency to the other one to the purpose of minimizing, under any operating condition, the energy usage of the appliance.

A further purpose of the present invention is to enable the manufacturer to do away with the need of going through a function redesign of his range of refrigeration appliances, thanks to the fact that, at least at the lowest speed $n_1$ thereof, the driving motor of the compressor keeps operating intermittently. Owing to the fact that the present invention does not actually require any modification to be made on the thermostatic temperature control associated to the food storage compartment of the refrigeration appliance in which the compressor is installed, the same system may thus be come down even to a simple, well-known thermostat of the fluid-expansion type.

According to the present invention, these and further aims are reached in a control system having the characteristics as recited in the appended claims.

BRIEF DESCRIPTION OF DRAWINGS

Anyway, features and advantages of the present invention can more readily be understood from the description of a preferred embodiment that is given below by way of non-limiting example with reference to the accompanying drawings, in which.

DETAILED DESCRIPTION OF THE INVENTION

Figure 1:
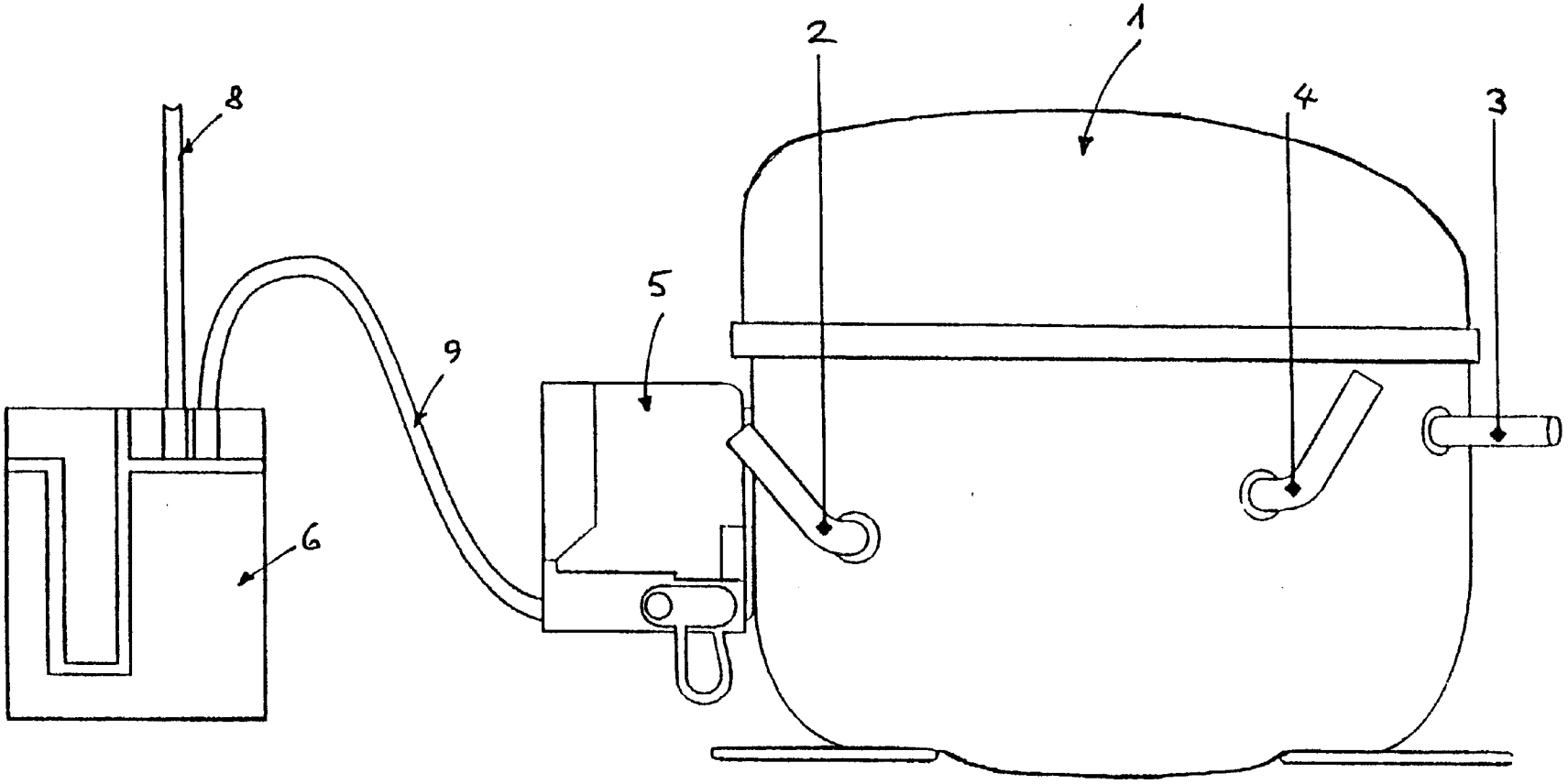
FIG. 1 is a schematical overall view of the compressor assembly.

In a per sé well-known manner, a compressor of refrigerant media for use in a home-type refrigeration appliance consists substantially of a metal sealed casing 1 that encloses both the actual compressor, of the reciprocating type, and the electric driving motor 10 provided coaxially thereto. From the outer surface of said sealed casing 1 there are protruding three metal tubes 2, 3, and 4 acting as the suction pipe, the delivery pipe and the service pipe, respectively. The same outer surface of the sealed casing 1 acts as the support for a cover 5 that encloses and protects the terminal box for the connection of a plug-cable (not shown) ensuring the power supply from the electric mains. Said terminal box is furthermore connected via a first wiring system 9 to a microprocessor-based control unit 7 (shown in FIG. 2 only), which performs in the manner that is explained further on, is enclosed in a proper protective box 6, and is in turn adapted to be connected to the thermostat 12 (which is also only shown in FIG. 2) of a refrigeration appliance via a second wiring system 8.

Figure 2:
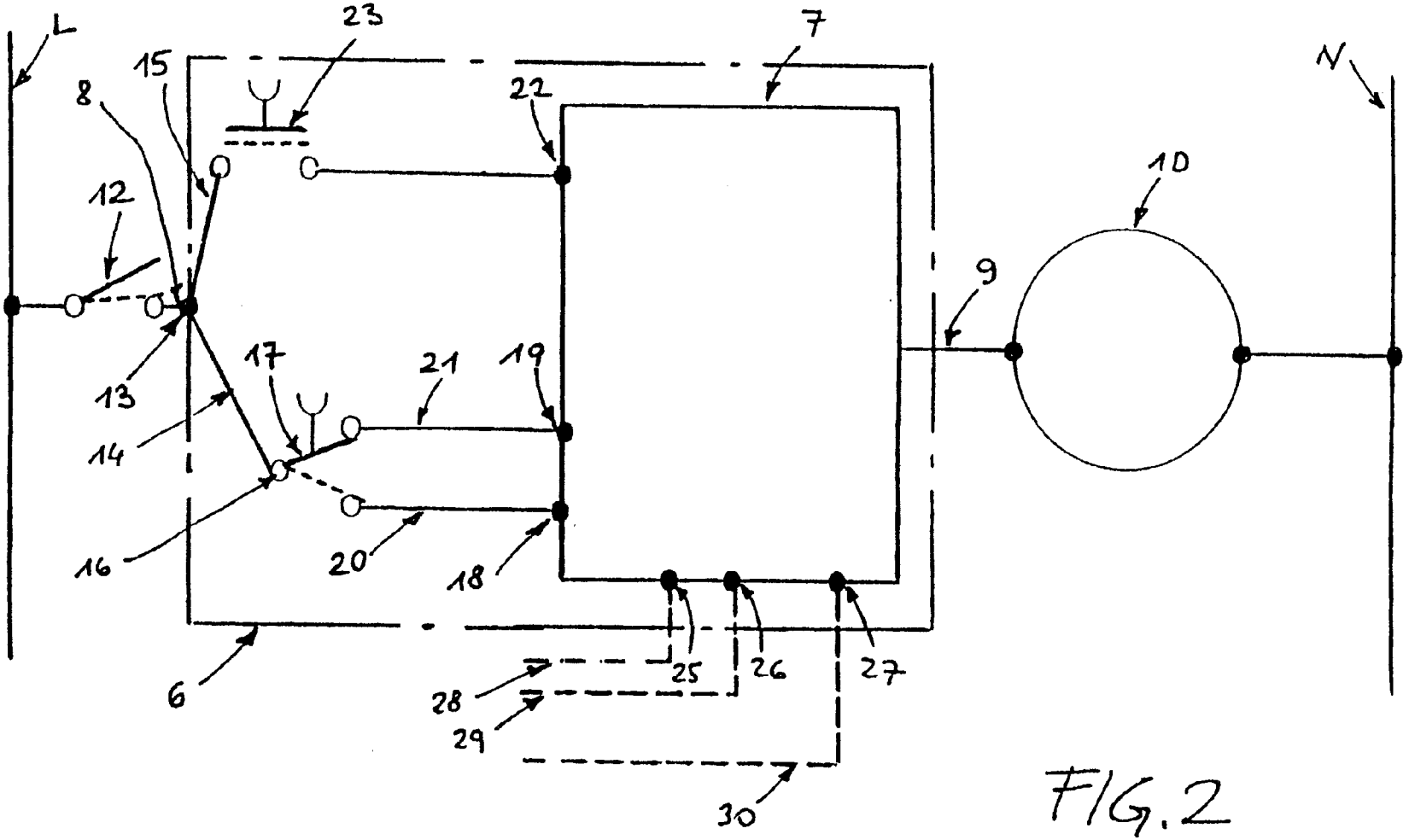
FIG. 2 is an electric wiring diagram relating to the connection of a driving motor for the compressor used in a refrigeration appliance of the so-called "cooler" type with automatic cyclic defrost operation.

In the wiring and connection diagram given to exemplifying purposes in FIG. 2, and which refers to the use of the compressor according to the present invention in a refrigeration appliance of the so-called "cooler" type with automatic cyclic defrost operation, further to the conductor leads L and N of the power supply plug-cable, the compressor driving motor 10 and the control unit 7 are for reasons of simplicity connected directly to each other both as far as signal and power are concerned via the above mentioned first wiring system 9. The above mentioned second wiring system 8 connects the thermostat 12, which is in turn connected to the line conductor lead L, to a point 13 acting as the interface with the already cited microprocessor-based control unit 7.

It should be right away noticed that the thermostat 12, which in this example of an application is used to control the temperature $T_i$ in the food storage room of the refrigeration appliance in which the compressor is installed, is not necessarily of a solid-state type, but can in an advantageous manner be also of the fluid-expansion type. Inside the box 6, to the interface point 13 there are connected two conductor leads 14 and 15 in a parallel arrangement. The first conductor lead 14 leads to the common contact 16 of a changeover switch 17 that is in turn adapted to selectively connect the interface point 13 with a first terminal contact 18 and with a second terminal contact 19 of the control unit 7 via the conductor leads 20 and 21, respectively. Along the second conductor lead 15, which is brought to the interface point 13 and ends at a third terminal contact 22 of the microprocessor-based control unit 7, there is provided a normally open switch 23.

In the preferred embodiment illustrated in FIG. 2, but not necessarily required for the implementation of the present invention, further terminal contacts 25, 26 and 27 of the control unit 7 constitute the inputs of further signals 28, 29 and 30, as this will be described in greater detail further on. For instance, the signal 28 that reaches the contact 25 may be the measurement signal of the actual temperature prevailing inside the food storage room, in the case that the refrigeration appliance is provided with an appropriate sensor (not shown), whereas the signal 29 reaching the contact 26 may refer to the opening rate and/or duration of the door of the food storage room and, finally, the signal 30, which is sent to the contact 27, may be the one relating to the storage room defrost operation.

According to an important feature of the present invention, the control unit 7 performs following tasks:

- it actuates the changeover switch 17 and causes it to switch over to connect the interface point 13 with either the first terminal contact 18 or the second terminal contact 19 of the control unit 7, so as to cause the compressor driving motor 10 to be supplied respectively at either a first and lower electric frequency $f_1$ or a second and higher electric frequency $f_2$, which are both lower than the frequency $f_N$ of the power supply current (50 or 60 Hz), ie. in the line conductor leads L and N. It will be readily appreciated that a pre-set speed of the motor 10 corresponds to each one of said frequencies, eg. a speed of 1,600 rpm may correspond to the frequency $f_1$, and a speed of 2,400 rpm may correspond to the frequency $f_2$;
- it actuates the normally open switch 23 to close on the third terminal contact 22 of the control unit 7 so as to short-circuit the above cited first and second terminal contacts 18 and 19 of the same control unit 7. In this way, the motor 10 is supplied at a frequency $f_T$ that is higher than the other two and may for instance be equal to the frequency $f_N$ of the power supply line, so as to enable the motor 10 to rotate at a speed of 3,000 rpm;
- it monitors, via the line 9, both the absolute duration of operation of the compressor driving motor 10 and the utilization index (generally known as operating percentage) thereof, which are two quantities that vary with time in a mutually independent manner. It is of course also capable of calculating both the absolute values and the possible combinations of said variable quantities and/or functions thereof, such as for instance the consecutive number of operating cycles of the motor 10 which have a determined operation or utilization index;

it compares the absolute values and/or the above mentioned combinations of said variable quantities with pre-set values to the purpose of issuing, when necessary, an input signal to cause the changeover switch 17 to switch over from the first to the second terminal contact 19, 20 of the control unit 7, or vice-versa, or even to cause the normally open switch 23 to close on the third contact 22 of the same control unit 7: this to the purpose of varying the electric supply frequency of the motor 10 from any one of the three above cited values $f_1$, $f_2$ and $f_T$ to any other one and, as a result, increasing or reducing the operating speed thereof;

it also monitors the on and off trippings of the thermostat switch 12 which, as anyone in the art is well aware of, is not a part of the compressor itself, but is anyway inherently provided in all refrigeration appliances.

Some examples of operation of the compressor according to the present invention are given below, as referred to the use of such a compressor in a "cooler"-type refrigeration appliance and, therefore, with an electric wiring and connection diagram as the one illustrated in FIG. 2.

EXAMPLE NO. 1

First Starting of the Appliance Upon Installation

Considering that the switch 12 of the refrigeration appliance is clearly closed, so that the interface point 13 is set under voltage, the control unit 7 causes the normally open switch 23 to close on the third terminal contact 22 so as to enable the compressor driving motor 10 to be supplied with power at the highest frequency $f_T$. As this has already been set forth earlier in this description, such a frequency may be the frequency $f_N$ of the power supply line (ie. 50 or 60 Hz, as the case may be), which causes the motor 10 to operate at a speed of 3,000 rpm. Such an operating condition is maintained all along the time that is necessary for the thermostat 12 to trip for the first time, thereby interrupting of course the power supply coming from the line conductor lead L.

EXAMPLE NO. 2

Regular Food Storage and Preservation Operation

Via the wiring line 9, the control unit 7 is able to find oui that the utilization index of the motor 10 is low, ie. it has namely failed to exceed a pre-set threshold value (which might be, say, in the order of 50%) throughout a predetermined number of consecutive tripping cycles (for instance, 5 cycles) of the thermostat 12. At this point, the same control unit 7 causes the changeover switch 17 to switch over in such a manner that, when the thermostat 12 is closed, the interface point 13 is capable of applying voltage to the first terminal contact 19 via the conductor lead 20 so as to enable the compressor driving motor 10 to be supplied with power at the lowest frequency $f_1$ and, as a result, to go on operating at a speed of just 1,600 rpm. As a result, from this moment on (and as long as the conditions do not change, as described in the following examples), the energy usage of the refrigeration appliance, as caused by the operation of the same compressor driving motor 10, is at a minimum, since it is actually reduced to just the amount of energy that is precisely required to keep the food storage compartment of the appliance at either the temperature selected by the user (eg. +4° C.) or a possibly set default temperature.

EXAMPLE NO. 3

Frequent Use of the Refrigeration Appliance for Loading and Removing Foodstffs Via the wiring line 9, the control unit 7 is capable of detecting that the compressor driving motor 10 has been operating at a high utilization index, ie. an index that is higher than the afore mentioned threshold value (eg. 50%), throughout a number (eg. 5) of consecutive cycles of the thermostat 12. At this point, the same control unit 7 causes the changeover switch 17 to switch over in such a manner that, when the thermostat 12 is closed, the interface point 13 is capable of applying the voltage of the line conductor lead L to the second terminal contact 19 via the conductor lead 21 so as to enable the compressor driving motor 10 to be supplied with power at the frequency $f_2>f_1$ and, as a result, to increase the operating speed thereof to 2,400 rpm. As a result, the energy usage of the refrigeration appliance increases, but only for the period of time that is necessary for the conditions described in Example no. 2 above to be restored.

EXAMPLE NO. 4

Prolonged Opening of the Door

The control unit is capable of ascertaining whether the door of the refrigeration appliance is kept open for an unusually long period of time, eg. owing to an inattention of the user, on the basis of at least one of the afore mentioned signals 28, 29 that reach the terminal contacts 25, 26 thereof. This causes the compressor driving motor 10 to operate through a prolonged period of time, in particular a period of time that is in excess of a pre-set threshold duration of 90 minutes. With the thermostat 12 in its closed position, it is therefore ensured that the changeover switch 17 is kept closed on the second terminal contact 19 of the unit 7.

It shall of course be appreciated that the compressor according to the present invention proves equally advantageous when used in connection with other types of refrigeration appliances, eg. freezers or fridge-freezer combinations, by introducing appropriate variants in the operating logic of the microprocessor-based control unit 7.

The advantages of the present invention may be summarized as follows:

the microprocessor-based control unit is an integral part of the compressor;

no functional re-design is required for any of the refrigeration appliances in which the compressor is going to be installed, not even as far as wirings are concerned;

it is on the contrary possible for even such time-proven, low-cost thermostats as the fluid-expansion ones to be further used in the above refrigeration appliances;

the energy usage of the appliances is precisely and automatically adapted to the actual operating conditions of the same appliances and, therefore, is is reduced to a minimum under the standard, ie. regular operating conditions that are used as a reference for the energy efficiency data stated in the energy label accompanying the appliances themselves;

similarly, the level of the noise generated by the appliances during operation is kept under control and, in practice, such a noise is kept at a certainly low level for most of the time.

It will be further appreciated that the compressor according to the invention may be implemented in a number of manners differing from the afore described embodiment. In particular, the power supply frequencies (and, therefore, the operating speeds) of the compressor driving motor may have both absolute and relative values differing from the afore indicated ones; in particular, none of the three frequencies may be equal to the power supply line frequency (50 or 60 Hz). Furthermore, other time-variable quantities may be used as a reference, such as for instance the current input of the driving motor.

It should also be noticed that, if desired, the manufacturer can add, on the control panel of his refrigeration appliances, appropriate manually operated means adapted to actuate the normally open switch and/or the changeover switch, ie. to double the functions thereof. In these cases, the microprocessor-based control unit is overridden and the refrigeration appliance requires the user to intervene manually in order to vary the operating speed of the compressor.

It should be finally noticed that it is in all cases possible for the operating logic of the microprocessor-based control unit 7 to be "personalized" in view of being able to duly take into account the actual installation conditions and/or any possible particular construction or design feature of the refrigeration appliance (eg. if the latter is of the type with more than two food storage compartments and, of course, as many food storage temperatures) in which the compressor is installed.

What is claimed is:

1. A compressor of refrigerant medium for a home-type or similar refrigeration apparatus, driven by a motor (10) whose power supply frequency is selectively variable between a discrete number of values ($f_1$, $f_2$, $f_T$) as a function of an input signal, characterized in that it integrally comprises control means (7) which are adapted to monitor two or more quantities that are variable with time in a mutually independent manner, of which at least one is representative of the actual operating conditions of the appliance, said control means being further adapted to generate said input signal with a value that corresponds to a preestablished combination of the monitored quantities, wherein the compressor also integrally comprises means for processing said input signal, which are from time to time adapted to privilege any of said time-variable quantities over the other ones as a function of the absolute value that such quantities take in a respective pre-set scale, and wherein one of said variable quantities is constituted by the utilization index of the driving motor (10) thereof.

2. A compressor of refrigerant medium for a home-type or similar refrigeration apparatus, driven by a motor (10) whose power supply frequency is selectively variable between a discrete number of values ($f_1$, $f_2$, $f_T$) as a function of an input signal, characterized in that it integrally comprises control means (7) which are adapted to monitor two or more quantities that are variable with time in a mutually independent manner, of which at least one is representative of the actual operating conditions of the appliance, said control means being further adapted to generate said input signal with a value that corresponds to a pre-established combination of the monitored quantities.

wherein the compressor also integrally comprises means for processing said input signal, which are from time to time adapted to privilege any of said time-variable quantities over the other ones as a function of the absolute value that such quantities take in a respective pre-set scale, and wherein one of said variable quantities is constituted by the absolute duration of the operation of the driving motor (10) thereof.

3. A compressor of refrigerant medium for a home-type or similar refrigeration apparatus, driven by a motor (10) whose power supply frequency is selectively variable between a discrete number of values ($f_1$, $f_2$, $f_T$) as a function of an input signal, characterized in that it integrally comprises control means (7) which are adapted to monitor two or more quantities that are variable with time in a mutually independent manner, of which at least one is representative of the actual operating conditions of the appliance, said control means being further adapted to generate said input signal with a value that corresponds to a pre-established combination of the monitored quantities, wherein the compressor also integrally comprises means for processing said input signal, which are from time to time adapted to privilege any of said time-variable quantities over the other ones as a function of the absolute value that such quantities take in a respective pre-set scale, and wherein one of said variable quantities is constituted by the electric current input of the driving motor (10) thereof.

4. A compressor of refrigerant medium for a home-type or similar refrigeration apparatus, driven by a motor (10) whose power supply frequency is selectively variable between a discrete number of values ($f_1$, $f_2$, $f_T$) as a function of an input signal, characterized in that it integrally comprises control means (7) which are adapted to monitor two or more quantities that are variable with time in a mutually independent manner, of which at least one is representative of the actual operating conditions of the appliance, said control means being further adapted to generate said input signal with a value that corresponds to a pre-established combination of the monitored quantities.

wherein the compressor also integrally comprises means for processing said input signal, which are from time to time adapted to privilege any of said time-variable quantities over the other ones as a function of the absolute value that such quantities take in a respective pre-set scale, and wherein the ratio of the highest power-supply frequency ($f_T$) to the lowest power-supply frequency ($f_1$) of the driving motor (10) thereof is comprised between 1.4 and 2.1 and is preferably anywhere near 2.

* * * * *

UNITED STATES PATENT AND TRADEMARK OFFICE

CERTIFICATE OF CORRECTION

PATENT NO. : 6,668,571 B1
DATED : December 30, 2003
INVENTOR(S) : Bertotti et al.

It is certified that error appears in the above-identified patent and that said Letters Patent is hereby corrected as shown below:

Column 1,
Line 40, "...the temperature $T_1$ of the room…", should be -- ...the termperature $T_1$ of the room. --;
Line 47, "...ratio $n_s n_i$ between the speed…", should be -- ratio $n_s$, $n_i$ between the speed… --;

Column 5,
Line 48, "...is able to find *oui*…, should be -- …is able to find *out*… --;

Column 8,
Line 3, "...of the monitored *quantities*.", should be -- …of the monitored *quantities,* --;
Line 45, "...of the monitored *quantities*.", should be -- …of the monitored *quantities,* --;

Signed and Sealed this

Twenty-second Day of June, 2004

JON W. DUDAS
*Acting Director of the United States Patent and Trademark Office*